United States Patent [19]

Welsby et al.

[11] Patent Number: 4,846,714

[45] Date of Patent: Jul. 11, 1989

[54] QUICK DISCONNECT CONNECTOR

[75] Inventors: Scott D. Welsby; Stanley E. Hanson, both of Colorado Springs, Colo.

[73] Assignee: Kaman Instrumentation Corporation, Colorado Springs, Colo.

[21] Appl. No.: 194,439

[22] Filed: May 16, 1988

[51] Int. Cl.[4] ..... H01R 4/50; H01R 13/62

[52] U.S. Cl. ..... 439/348; 285/316; 439/180

[58] Field of Search ..... 439/348, 352, 372, 180; 285/316; 279/19.3, 30, 22

[56] References Cited

U.S. PATENT DOCUMENTS

| | | | |
|---|---|---|---|
| 3,678,439 | 7/1972 | Vetter | 439/348 |
| 4,403,959 | 9/1983 | Hatakeyama | 285/316 |

FOREIGN PATENT DOCUMENTS

| | | | |
|---|---|---|---|
| 2462797 | 2/1981 | France | 439/348 |
| 2100651 | 1/1983 | United Kingdom | 279/19.3 |

*Primary Examiner*—Neil Abrams
*Assistant Examiner*—Khiem Nguyen
*Attorney, Agent, or Firm*—Fishman, Dionne & Cantor

[57] ABSTRACT

A male quick disconnect SMA connector is provided which may be easily and readily installed on any existing female SMA connector by simply installing an adapter ring. The male SMA connector includes an inner sub-assembly comprised of an inner housing having a hermetically glass sealed male connector pin extending therefrom. An outer housing is received over the inner sub-assembly and a compressive spring is positioned in a cavity between the inner and outer housings. An insert is provided to the front of the outer housing. The insert includes several recesses for retaining rolling locking pins therein. These locking pins are raised when the outer housing is retracted (thereby compressing the spring) in a first direction. Thereafter, the locking pins are lowered into retaining openings in an adapter ring on the female SMA by releasing the outer housing to its original orientation with respect to the inner housing.

22 Claims, 9 Drawing Sheets

QUICK DISCONNECT CONNECTOR

BACKGROUND OF THE INVENTION

This invention relates generally to an electrical connector. More particularly, this invention relates to a new and improved electrical connector for coaxial cable assemblies, commonly known as SMA (Sub-Miniature Series A) connectors.

Coaxial cable has been increasingly used for certain microwave and other applications. Typically, the requirements for miniature coaxial cables have been governed by the Military Specification for Coaxial Connectors (MIL-C-39012). The military designation for such miniature coaxial connectors is SMA (Sub-Miniature Series A); and this designation has become the well known and recognized name for such connectors.

SMA connectors essentially comprise a male connector consisting of a conductive pin extending from the center of a dielectric plug and a female connector consisting of a sleeve which receives and makes electrical contact with the pin. Standard SMA connectors utilize a threaded coupling or locking nut as the locking mechanism to connect the male and female connectors.

Despite the widespread use of the standard SMA connectors, the threaded locking nut presents certain significant drawbacks and problems. For example, the use of a threaded coupling nut does not allow for quick installation and/or removal of coaxial cable assemblies; particularly when installing many cables. Also, accessing the threaded coupling nut can sometimes be difficult, particularly in confined spaces where turning a nut is not possible or practical.

SUMMARY OF THE INVENTION

The above-discussed and other drawbacks and deficiencies of the prior art are overcome or alleviated by the quick disconnect SMA connector of the present invention. In accordance with the present invention, a male SMA connector is provided which may be easily and readily installed on any existing female SMA connector by simply installing an adapter ring. The male SMA connector includes an inner sub-assembly comprised of an inner housing having a hermetically glass sealed male connector pin extending therefrom. An outer housing is received over the inner sub-assembly and a compressive spring is positioned in a cavity between the inner and outer housings. An insert is provided to the front of the outer housing. The insert includes several recesses for retaining rolling locking pins therein. These locking pins are raised when the outer housing is retracted (thereby compressing the spring) in a rearward direction. Thereafter, the locking pins are lowered into retained openings in an adapter ring on the female SMA by releasing the outer housing to its original orientation with respect to the inner housing.

The quick disconnect SMA connector of the present invention has many advantages relative to prior art connector systems. For example, any coaxial cable assembly incorporating the SMA connectors of the present invention may be quickly connected and disconnected without the use of conventional wrenches since a torque wrench is not required to achieve the proper mate between the present invention and mating connector.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several figures.

DESCRIPTION OF THE PREFERRED EMBODIMENT

Figure 1:
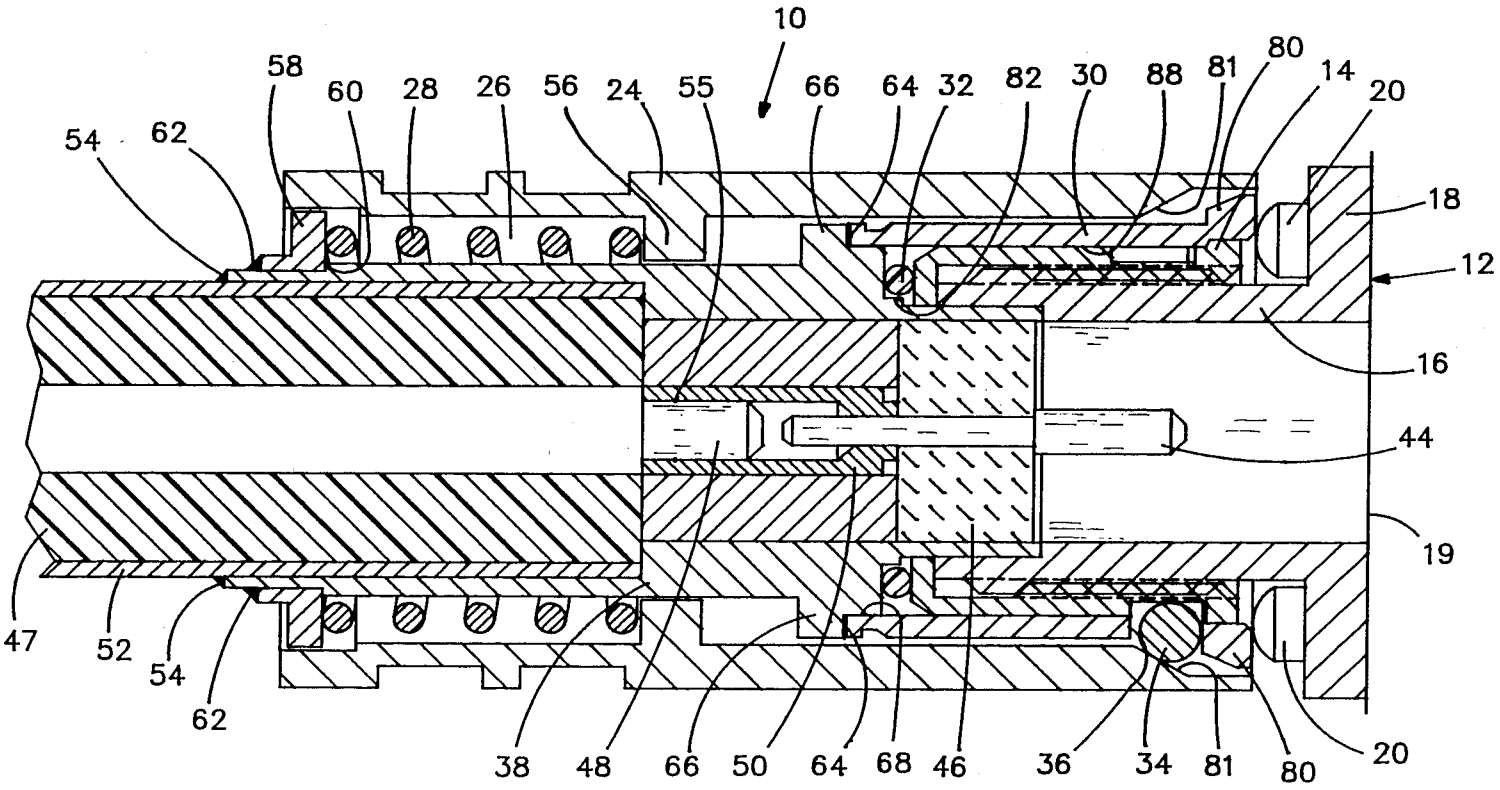
FIG. 1 is a cross sectional elevation view of a SMA connector in accordance with the present invention.

Referring first to FIG. 1, a SMA connector in accordance with the present invention is shown generally at 10. Connector 10 comprises a male connector element shown attached to a conventional SMA female connector element 12 by virtue of an adapter ring 14 threaded onto female element 12. Female element 12 comprises a cylindrical section 16 extending from a flange member 18. The interior of cylindrical element 16 includes a female receiver (not shown). The exterior of cylindrical element 16 has threading thereon for threadibly mating with adapter ring 14 as will be discussed in more detail below. Flange member 18 is mounted to a bulkhead or panel 19 (e.g. electrical boxes or other structural members) and is typically referred to as a "panel mount" or "bulkhead" connector. Flange 18 is fixed to support 19 by several (usually four) suitable threaded fasteners 20 which pass through an opening in flange 18 and is threaded into the supporting structure 19.

Figure 2:
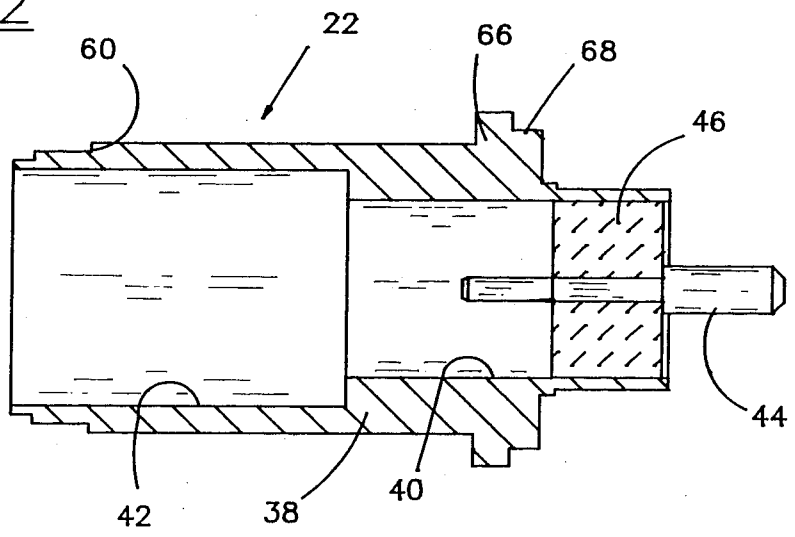
FIG. 2 is a cross sectional elevation view of the inner sub-assembly used in the connector of FIG. 1.
Figure 3A:
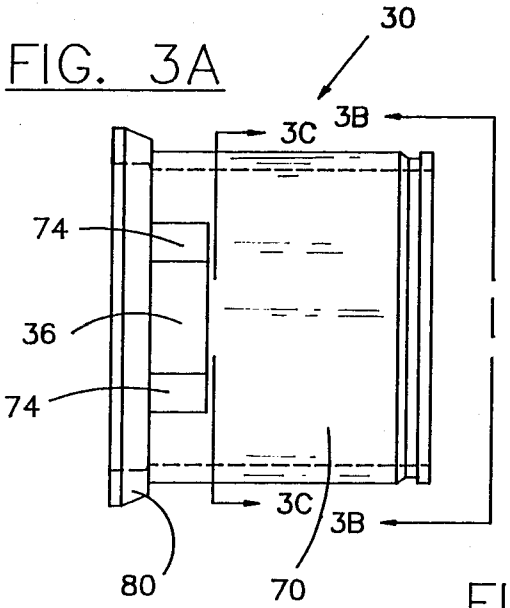
FIG. 3A is a side elevation view of the front insert used in the connector of FIG. 1.
Figure 3B:
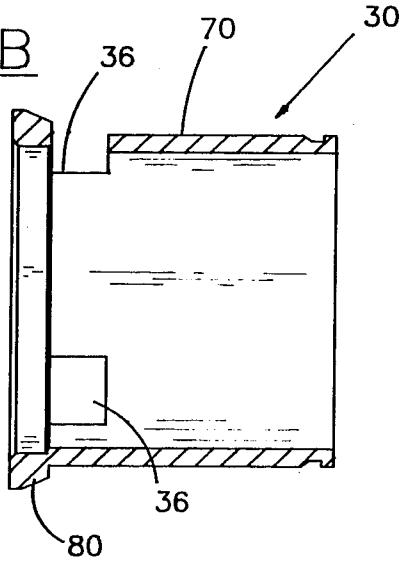
FIG. 3B is a cross sectional elevation view along the line 3B—3B of FIG. 3A.
Figure 3C:
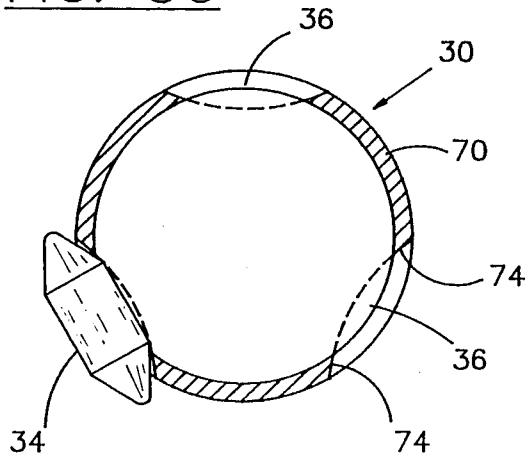
FIG. 3C is a cross sectional elevation view along the line 3C—3C of FIG. 3A.
Figure 4:
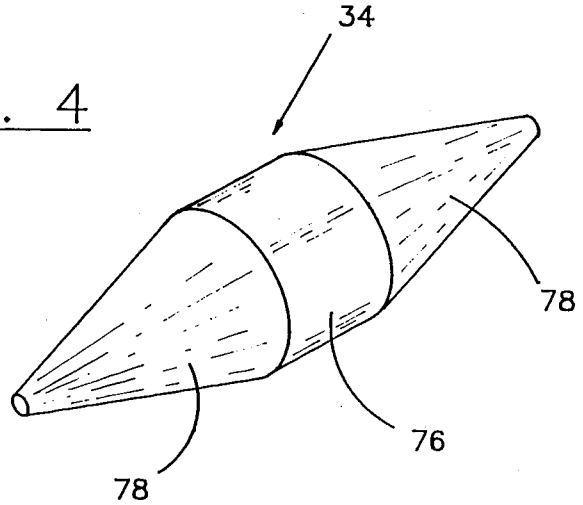
FIG. 4 is a perspective of a locking roller pin used in the SMA connector of FIG. 1.

Referring jointly to FIGS. 1–5, the SMA male connector of the present invention includes an inner sub-assembly best shown at 22 in FIG. 2, an outer sleeve or housing 24 surrounding sub-assembly 22, a cavity 26 defined between outer housing 24 and sub-assembly 22 having a compression spring 28 therein, a front body or annular insert 30 attached to the front end of sub-assembly 22, an O-ring 32 sandwiched between adapter 14 and sub-assembly 22 and a plurality of locking roller pins 34 received in openings 36 in body 30 (see FIGS. 3 and 4).

Inner sub-assembly 22 comprises an inner housing 38 which is substantially an annular sleeve. The interior of housing 38 includes a first portion 40 and a second portion 42 of larger diameter. Portion 40 includes an inner conductor 44, the lower section of which is hermetically sealed in glass 46 (typically a type of Borosilicate). Inner conductor 44 is electrically connected to the inner conductor 48 of coaxial cable 47 by a known spring finger 50. The remaining space between glass seal 46 and the coaxial cable 47 is filled with a suitable dielectric material. The metal shielding 52 on coaxial cable 47 is welded to inner housing 38 as indicated at 54. In addition, welds are provided between spring finger 50 and inner conductor 48 as indicated at 55.

Outer sleeve 24 also has a generally annular configuration. Cavity 26 is defined between sleeve 24 and inner housing 38 by a step 56 which extends radially from the inside surface of sleeve 24 and a ring 58 which abuts a shoulder 60 on housing 38. Ring 58 is welded at 62 to inner housing 38. Compression spring 28 is positioned in cavity 26 and bears against both step 56 and ring 58.

Turning to FIGS. 1 and 3A–3C, annular insert or front body 30 is welded at 64 to a flange 66 on the exterior of inner housing 38. Flange 66 includes a shelf 68 (see FIG. 2) which provides a seat for insert 30. The outer cylindrical surface 70 of insert 30 includes several openings 36 for holding and aligning roller pins 34. In a preferred embodiment, insert 30 includes three equally spaced openings 36 as shown in FIG. 3C. These openings 36 have opposed sloped side edges 74 for receiving three locking pins, one of which is shown in perspective at 34 in FIG. 4. Locking pin 34 has a cylindrical central portion 76 of equal cross section and oppositely disposed conical shaped end portions 78. It will be appreciated that conical ends 78 bear against respective sloped edges 74 of openings 36. Insert 30 terminates at a flange 80 of larger diameter so that when roller pins are placed in openings 36, the small distance between the inside surface 81 of outer sleeve 24 and flange 80 will prevent roller pins 34 from falling out. Also, sloped bearing surface 81 on the interior surface of outer sleeve 24 will be urged against roller pins 34 as a result of compression spring 28.

An O-ring 32 is positioned about a shelf 82 on inner housing 38 and functions as a moisture seal when male SMA connector 10 is mated to female SMA connector 12. A moisture seal is necessary to prevent moisture from entering the electrical interface between the male and female SMA connectors and thereby adversely effect the RF performance of the connection.

Figure 5:
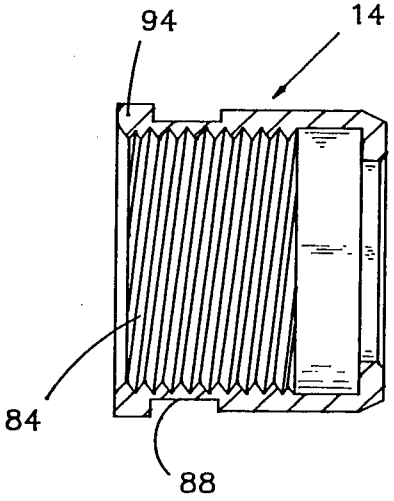
FIG. 5 is a cross sectional elevation view of an adapter ring used on a female SMA connector in accordance with the present invention.

As best seen in FIG. 5, threaded adapter 14 has internal threading 84 which is threadibly received on female connector 12. The outer surface of adapter 14 includes a groove 88 of preferably rectangular cross section. As will be clear from a review of FIGS. 7A–7E, groove 88 acts as the locking surface for roller pins 34.

Figure 6:
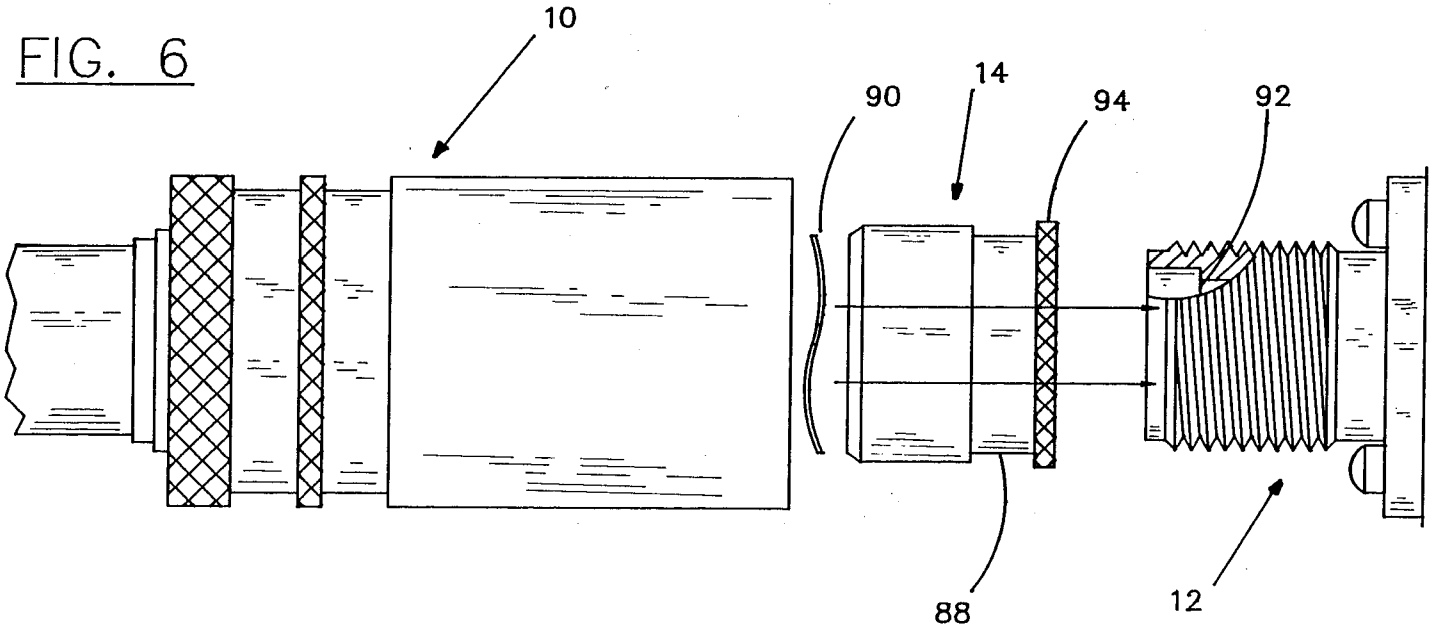
FIG. 6 is an exploded side section elevation views showing sequential assembly steps of the SMA connector of FIG. 1.

The operation of the SMA connector of the present invention will now be discussed with reference to FIGS. 6 and 7A–7E. Turning first to FIG. 6, a suitable locktite adhesive should be applied to the threading on female connector 12 to secure adapter 14. Next, adapter 14 is tightly threaded to the SMA female fitting 12. Preferably, a wave washer 90 is then installed inside SMA female connector 12. Wave washer 90 should touch internal surface 92 in female connector 12. Male SMA connector 10 can now be quickly and easily mated to female connector 12/adapter 14.

Figure 7A:
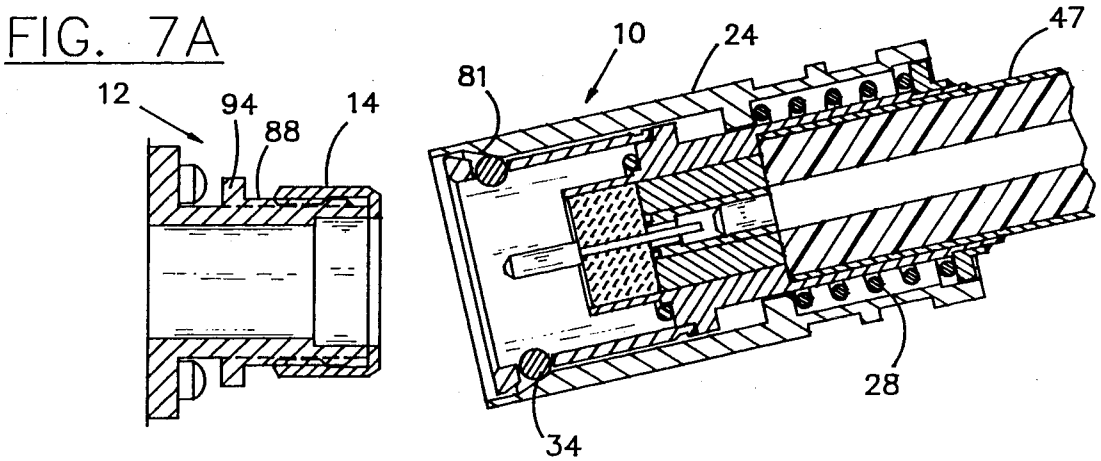
FIGS. 7A–7E are cross section elevation views showing sequential assembly steps of the SMA connector of FIG. 1.
Figure 7B:
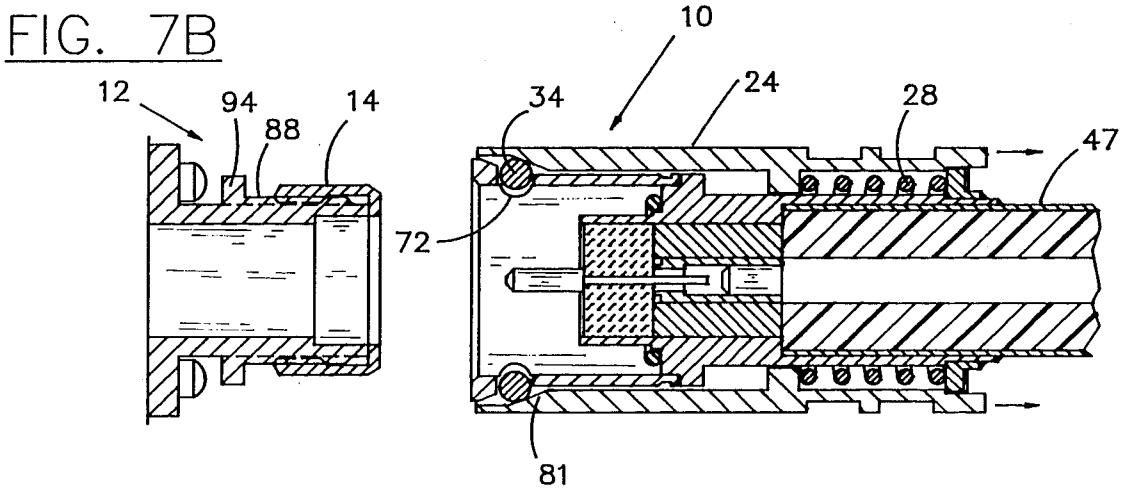
Figure 7C:
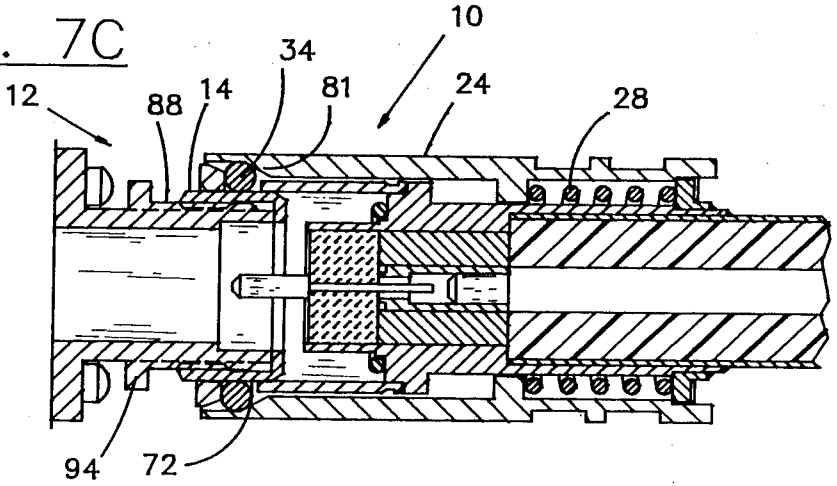

As shown in FIG. 7A, male SMA 10 is brought into alignment with female SMA 12. Next, the coaxial cable 47 is held firmly and outer connector housing 24 is grasped and slid backwardly in the direction of the arrows in FIG. 7B. This will result in both compression of spring 28 and the release of sloped bearing surface 81 from rolling pins 34. Connector 10 is then installed over adapter 14 as shown in FIG. 7C. It will be appreciated that when adapter 14 contacts pins 34, the pins will be urged upwardly out of openings 36 and then be stopped by outer sleeve 24 as is clear in FIG. 7C.

Figure 7D:
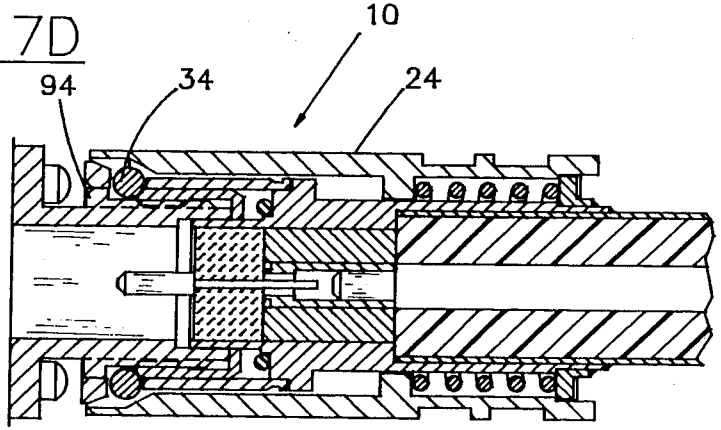
Figure 7E:
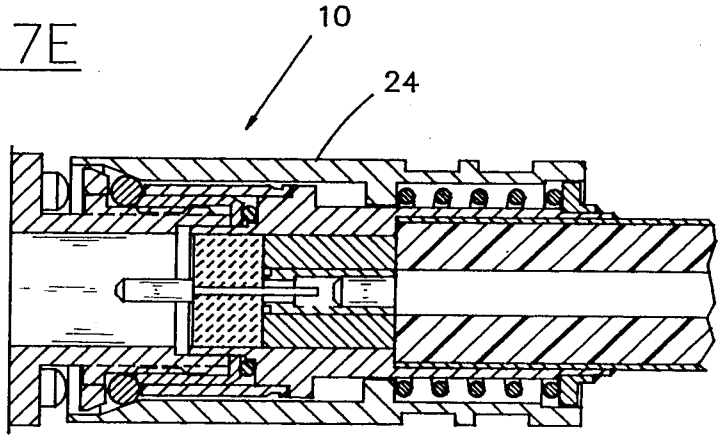

Next, connector 10 is further slid onto adapter 14 until flange 80 of insert 30 contacts the knurled collar 94 on adapter 14 (see FLANGE 6). At this position, openings 36 in insert 30 will be aligned with groove 88 in adapter 14 so that roller pins 34 will drop into the groove as shown in FIG. 7D. Finally, the connector housing 25 is allowed (by virtue of compressed spring 28) to move back to its normal position whereupon sloped bearing surface 81 will lock and retain pins 34 in groove 88 (FIG. 7E). The connector housing 24 is then rotated 45 to 90 degrees to assure proper connector mating.

Disassembly of the mated SMA connector shown in FIG. 7E is easily and quickly accomplished by reversing the steps outlined above.

It will be appreciated that while adapter 14 has been shown as a discrete element threaded to female SMA 12, the present invention also contemplates that adapter 14 and female SMA 12 may be manufactured as one piece.

While preferred embodiments have been shown in described, various modifications and substitutions may be made thereto without departing from the spirit and scope of the invention. Accordingly, it is to be understood that the present invention has been described by way of illustrations and not limitation.

What is claimed is:

1. A male coaxial cable connector comprising:

an inner sleeve having an interior and an exterior;

a male connector element sealed in said interior of said inner sleeve and protruding from said inner sleeve;

an outer sleeve surrounding and spaced from said inner sleeve;

a cavity defined between said inner and outer sleeves;

compression means in said cavity;

annular insert means extending from said inner sleeve and spaced from said outer sleeve;

at least one opening through said insert means;

at least one elongated locking roller pin means resting in said opening and protruding partially through said opening, said roller pin means being transverse to said annular insert means; and said outer sleeve including a sloped bearing surface for retaining said roller pin means in said opening, said compression means urging said sloped bearing surface against said roller pin means.

2. The device of claim 1 including:

a female coaxial connector having an outer surface, said outer surface including mating means for receiving said roller pin means when said opening in said insert means is aligned with said mating means.

3. The device of claim 2 wherein:

said mating means is located on annular adapter means, said adapter means being threadibly received on said female coaxial connector.

4. The device of claim 1 wherein:

said cavity is defined by a ring extending radially from said outer sleeve and annular stop means fixed to said inner sleeve, said spring normally bearing against said ring and said stop means.

5. The device of claim 1 wherein:

said roller pin means includes a central cylindrical section and opposed conically shaped end sections.

6. The device of claim 5 wherein:

said opening includes opposed sloped edges which cooperate with said conically shaped end sections of said roller pin means.

7. The device of claim 1 including:

at least three openings in said insert means, and one roller pin means in each of said openings.

8. The device of claim 1 wherein:

said compression means comprises a spring.

9. The device of claim 1 wherein:

said annular insert means is fixed to a shoulder on said inner sleeve.

10. The device of claim 1 wherein:

said annular insert means is welded to said inner sleeve.

11. The device of claim 1 including:

an O-ring positioned about said inner sleeve between said inner sleeve and said insert means.

12. The device of claim 2 wherein:

said mating means comprises an annular groove.

13. The device of claim 3 wherein:

said mating means comprises an annular groove.

14. A male coaxial cable connector comprising:

an inner sleeve having an interior and an exterior;

a male connector element sealed in said interior of said inner sleeve and protruding from said inner sleeve;

an outer sleeve surrounding and spaced from said inner sleeve;

a cavity defined between said inner and outer sleeves;

compression means in said cavity;

annular insert means extending from said inner sleeve and spaced from said outer sleeve;

at least one opening through said insert means;

at least one elongated locking roller pin means resting in said opening and protruding partially through said opening, said roller pin means being transverse to said annular insert means;

said outer sleeve including a sloped bearing surface for retaining said roller pin means in said opening, said compression means urging said sloped bearing surface against said roller pin means; and a female coaxial connector having an outer surface, said outer surface including mating means for receiving said roller pin means when said opening in said insert means is aligned with said mating means.

15. The device of claim 14 wherein:

said mating means is located on annular adapter means, said adapter means being threadibly received on said female coaxial connector.

16. The device of claim 14 wherein:

said cavity is defined by a ring extending radially from said outer sleeve and annular stop means fixed to said inner sleeve, said spring normally bearing against said ring and said stop means.

17. The device of claim 14 wherein:

said roller pin means includes a central cylindrical section and opposed conically shaped end sections.

18. The device of claim 17 wherein:

said opening includes opposed sloped edges which cooperate with said conically shaped end sections of said roller pin means.

19. The device of claim 14 including:

at least three openings in said insert means, and one roller pin means in each of said openings.

20. The device of claim 14 wherein:

said compression means comprises a spring.

21. The device of claim 14 wherein:

said mating means comprises an annular groove.

22. The device of claim 15 wherein:

said mating means comprises an annular groove.

* * * * *